United States Patent [19]

Krause

[11] 4,140,498

[45] Feb. 20, 1979

[54] IN-THE-WALL-MOUNTED ELECTROSTATIC AIR CLEANER

[75] Inventor: James A. Krause, Harrison, Ark.

[73] Assignee: Emerson Electric Co., St. Louis, Mo.

[21] Appl. No.: 863,850

[22] Filed: Dec. 23, 1977

[51] Int. Cl.[2] ..... B03C 3/32

[52] U.S. Cl. ..... 55/139; 55/126; 55/385 A; 55/411; 55/480

[58] Field of Search ..... 55/126, 138, 139, 385 A, 55/411, 412, 480; 21/74 A, 74 R, 102 R; 49/397; 220/331

[56] References Cited

U.S. PATENT DOCUMENTS

| | | | |
|---|---|---|---|
| 1,199,596 | 9/1916 | Noll | 220/331 |
| 2,486,520 | 11/1949 | Dahlman | 55/126 |
| 2,873,000 | 2/1959 | Elam | 55/138 |
| 2,990,911 | 7/1961 | Lippincott | 55/139 |
| 3,222,848 | 12/1965 | Kolble, Jr. | 55/126 |
| 3,504,482 | 4/1970 | Goettl | 55/139 |
| 3,513,634 | 5/1970 | Angonese et al. | 55/139 |
| 3,630,000 | 12/1971 | Mullings | 55/139 |

*Primary Examiner*—Frank W. Lutter
*Assistant Examiner*—David L. Lacey
*Attorney, Agent, or Firm*—Charles E. Markham

[57] ABSTRACT

An electrostatic air cleaner includes a casing adapted to be mounted in a ceiling or sidewall between ceiling joists or sidewall studs, the casing having an adjustable outlet, a grille and pre-filter detachably connected to its inlet or room side, and an ionizing and collector cell mounted therein for convenient removal or replacement. The cell is detachably pivoted at one end in the casing so that it may be swung outward when removing it from the casing.

5 Claims, 9 Drawing Figures

IN-THE-WALL-MOUNTED ELECTROSTATIC AIR CLEANER

This invention relates to electrostatic air cleaners and particularly to one constructed and arranged to be mounted in a ceiling or sidewall of a living space.

When air heating or cooling apparatus for delivering conditioned air to a living space is positioned in an attic above or in a utility room alongside the living space and the return air is to be cleaned by an electrostatic air cleaner, it is frequently advantageous to mount the air cleaner in an opening in the ceiling or sidewall separating the living space from the air conditioning apparatus. It is also frequently customary in such arrangements to employ a duct leading from the air cleaner to the air conditioning apparatus.

Accordingly, it is an object of this invention to provide an electrostatic air cleaner having a casing adapted to be mounted in an opening in the ceiling or sidewall of a living space between and connected to two adjacent horizotal ceiling joints or vertical wall studs and having an inlet on the living space side, an outlet on the opposite side, and an electrostatic precipitator cell mounted therein for convenient removal and replacement.

A further object is to provide an air cleaner as in the preceding paragraph in which the precipitator cell is detachably hinged at one end in the casing so that the other end thereof may be swung outwardly when removing the cell from the casing.

A further object is to provide an electrostatic air cleaner of this kind which includes a grille and pre-filter detachably connected to the inlet side of said casing for convenient removal and replacement.

A further object is to provide an electrostatic air cleaner having a casing with an inlet and outlet side and an electrostatic precipitator cell mounted therein, in which the casing is provided with an adjustable flanged outlet adapted to accommodate the connection thereto of flexible ducts of varying size.

A further object is to provide in an electrostatic air cleaner a casing with an inlet and outlet side, a grille detachably connected to the inlet side, an electrostatic precipitator cell and a high voltage generating means in the casing, in which a normally open switch operative to connect the high voltage generating means to a source of electrical power when closed is engaged by the grille and moved to a closed position only when the grille is in assembled position and connected to the casing.

A further object is to provide an electrostatic air cleaner as in the preceding paragraph, in which the electrostatic precipitator cell is mounted in the casing for convenient removal and replacement and in which a normally open switch operative to connect the cell to the output of the high voltage generating means when closed is moved to a closed position when the cell is inserted in the casing.

These and other objects and advantages will become apparent when reading the following description in connection with the accompanying drawings.

Figure 1:
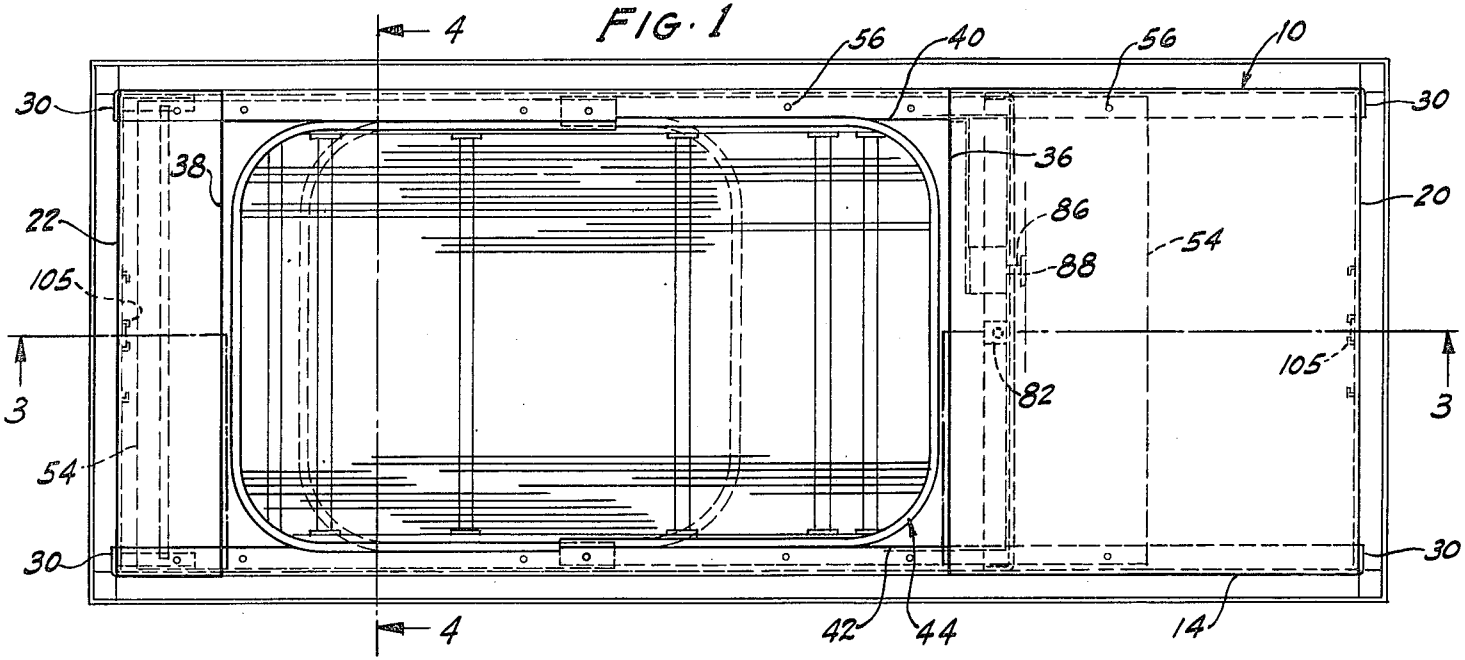
FIG. 1 is a top plan view or outlet side of a ceiling mounted electrostatic air cleaner constructed in accordance with the present invention.

Referring to the drawings in more detail, an electrostatic air cleaner having an elongated casing 10 is positioned in an opening in the ceiling of a living space between two adjacent ceiling joists 12, thereby to clean the air returning from the living space to air conditioning apparatus positioned in an attic space above. The casing 10 comprises two vertically arranged longitudinal side panels 14 having upper edge portions 16 thereof formed horizontally inward and lower edge portions 18 thereof formed horizontally outward, see FIG. 4.

Figure 3:
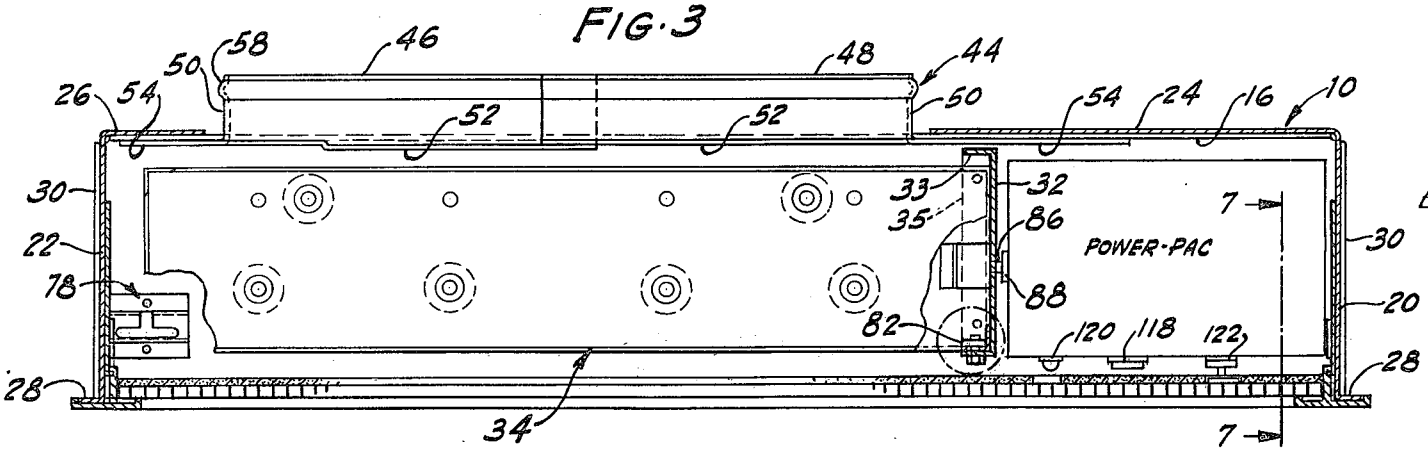
FIG. 3 is a cross-sectional view taken along line 3—3 of FIG. 1.

Casing 10 further comprises two vertically arranged transverse end panels 20 and 22 having upper portions 24 and 26 thereof formed horizontally inward and lower edge portions 28 thereof formed horizontally outward, see FIG 3. End portions 30 of the vertical side panels 14 are formed to overlap the vertical edge portions of end panels 20 and 22 and are connected thereto by riveting or spot welding. Likewise, the horizontally formed upper edges 16 of side panels 14 underlie the edges of horizontally formed portions 24 and 26 of end panels 20 and 22 and are suitably connected thereto by riveting or spot welding. The casing 10 is suitably held in position between joists 12 by nails or screws (not shown) extending through side panels 14.

An intermediate, transverse, vertically arranged dividing panel 32 divides the casing 10 into a relatively long left-hand compartment containing an elongated rectangular ionizing and collector cell 34 and a relatively short right-hand compartment containing a high voltage generating means, designated "POWER PAC." The dividing panel 32 has upper and lower horizontally formed flanges 33 and is further provided with end flanges 35 along its vertical edges connected by suitable means to side panels 14 of frame 10.

The ends 36 and 38, see FIG. 1, of the horizontally formed portions 24 and 26 of the casing end panels 20 and 22 and the edge portions 40 and 42 of the horizontally formed upper portions 16 of side panels 14 define a rectangular outlet opening in the top of casing 10 which is generally centered in the longer left-hand compartment of the casing containing the cell 34. Extending upward through this opening is an upstanding adjustable outlet collar, generally indicated at 44, defining a somewhat smaller outlet opening of generally rectangular form with rounded corners.

The outlet collar 44 comprises left and right-hand sections 46 and 48 arranged for telescoping adjustment, thereby to vary the size of the outlet opening defined by collar 44. Each of the outlet collar sections 46 and 48 comprise an upstanding collar portion 50, a horizontally outward formed skirt 52 extending laterally under horizontally formed upper casing side panel portions 16 and extending longitudinally under the upper horizontally formed portions of end panels 20 and 22 as indicated at 54, see FIG. 3. The skirt portions 52 and the upper horizontally formed portions 16 of side panels 14 have punched holes 56 therealong to receive drive screws for attaching the collar sections in an adjusted position.

The upstanding portions 50 of the outlet collar sections have an outwardly projecting bead 58 formed thereon to facilitate the retention of one end of a flexible duct 60, shown in part in dotted line, for connecting the outlet of the air cleaner to the intake of air conditioning apparatus. The casing 10 is of such width that it fits the standard 16-inch, center-to-center spacing of horizontal floor joists or vertical wall studs, and the adjustable collar 44 renders the device readily adaptable to connection with air conditioning apparatus having variably sized inlets requiring flexible ducts of a size suitable for connection to the inlet of the apparatus.

The ionizing and collector cell 34 is hinged at one end to the casing side panels 14 in the longer left-hand compartment of the casing 10 so that the cell 34 may be swung outwardly from the lower, inlet side of casing 10. The cell 34 has a rectangular frame comprising a pair of longitudinal side panels 62 having upper and lower edge portions turned horizontally outward to form flanges 64 and transverse upper and lower angle members 66 connecting the ends of side panels 62, see FIG. 4. Mounted in the cell frame are the usual ionizing wires 68 and collector plates 70 supported on rods 72 connected at their ends to the frame side panels 62.

Figures 2, 4, 5, 6, 7, 8:
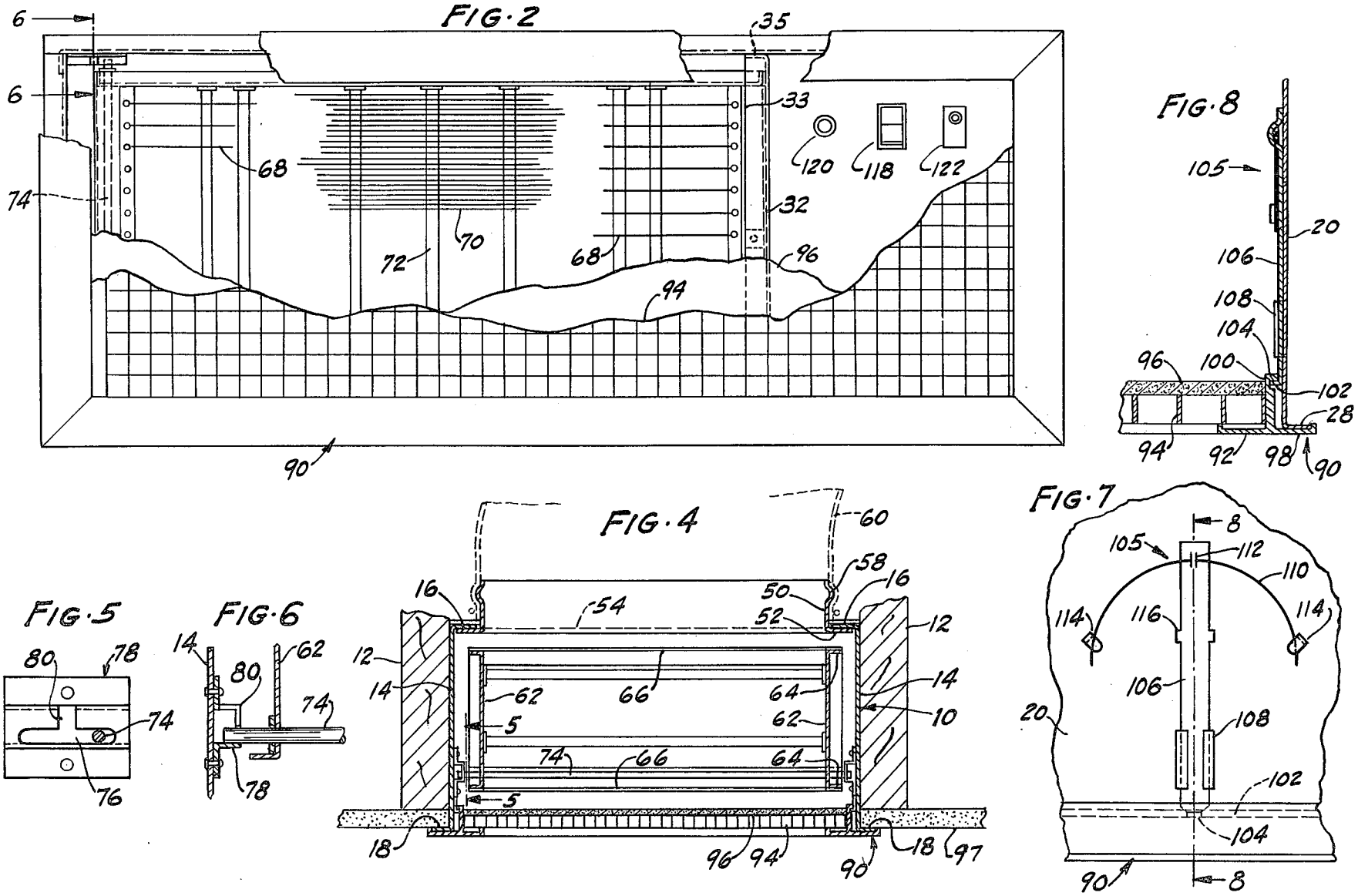
FIG. 2 is a bottom or inlet side plan view of the electrostatic air cleaner shown in FIG. 1.
FIG. 4 is a cross-sectional view taken along line 4—4 of FIG. 1.
FIG. 5 is an elevational view of the cell mounting bracket taken along line 5—5 of FIG. 4.
FIG. 6 is a fragmentary cross-sectional view taken along line 6—6 of FIG. 2.
FIG. 7 is an elevational view of one of the bow spring, grille retaining latches taken along line 7—7 of FIG. 3.
FIG. 8 is a fragmentary cross-sectional view taken along line 8—8 of FIG. 7.

There is a rod 74 extending transversely across the left-hand end of cell 34 near the bottom thereof which projects from each side of the cell frame to form a pair of trunnions, see FIGS. 2 and 4. The rod 74 is suitably attached to the side panels 62 of the cell frame and the projecting ends thereof are entered into horizontal journalling slots 76 in a pair of brackets 78 attached to the sidewalls 14 of the casing 10, see FIGS. 5 and 6. Brackets 78 are also provided with vertical entry slots 80, open at the top and intersecting horizontal slots 76 so that the ends of rods 74 may be entered or removed from the horizontal journalling slots 76.

Figure 9:
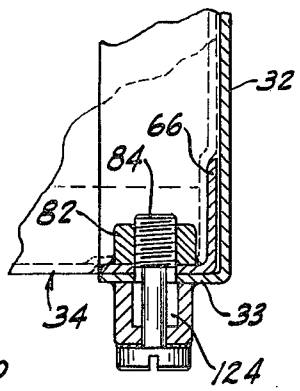
FIG. 9 is an enlarged detail view of the area within the dot-dash circle of FIG. 3, showing the means detachably connecting the non-hinged end of the cell to the casing.

The right-hand end of cell 34 rests on the lower flange 33 of the casing dividing panel 32 thereby providing stop means to prevent outward swinging of the right-hand end of cell 34. A nut 82 is welded to the lower transverse angle member 66 of the cell frame, see FIGS. 3 and 9, and captive screw 84 passing through the lower flange 33 of dividing panel 32 is threadedly engaged in nut 82 to detachably connect the lower right-hand end of cell 34 to the flange 33 of dividing panel 32.

A spring-loaded contact element 86 mounted in cell 34 engages a stationary output contact 88 of the POWER PAC to electrically connect the cell 34 to the POWER PAC when the cell 34 is moved horizontally toward the right into position on the flange 33 of dividing panel 32.

A rectangular frame 90 of generally T-form in cross section lies against the finished ceiling and supports a grille 94 and a pre-filter 96 at the inlet side of the opening in the ceiling. The frame 90 has an inwardly directed horizontal flange portion 92 supporting the grille 94 and pre-filter 96 and an outwardly directed horizontal flange portion 98 lying against the finished surface 97 of the ceiling. The intermediate vertical stem portion 100 of the T-form has an outwardly open groove 102 near its upper end which receives the lower horizontally formed tongues 104 of a pair of bow spring latch members 106, see FIGS. 7 and 8.

There is a bow spring latch, generally indicated at 105, at each end of the casing 10 mounted on the inside surface of the casing end panels 20 and 22. The bow spring latches 105 each comprise a vertically sliding latch member 106 lying flat against the casing end panel and guided for vertical sliding movement between guide elements 108, which are punched and formed as part of the casing end panels. The bow spring latches 105 further include a length of bowed spring wire 110 suitably attached intermediately of its length at 112 to the upper end of latch member 106. The end portions of spring wire 110 are slidably guided between horizontally spaced clips 114 which may also be punched out and formed as a part of the end panels of casing 10. There are also stop legs 116 on latch members 106 which limit the downward sliding movement of these members.

In the position shown in FIG. 7 with the center of the arc of bow spring 110 above the retaining clips 114, resistance to downward movement of latch members 106 is considerable and sufficient to hold the grille and pre-filter in assembled position in the inlet opening. When the frame and grille are pulled downward manually, the center of the arc of bowed spring 110 passes below the clips 114 and this resistance becomes zero. As the frame 90 and grille 94 are pulled downward sufficiently, the tongues 104 of latch members 106 are easily disengaged from the shallow grooves 102. The grille 94 and pre-filter 96 are suitably connected to the frame 90 by clips (not shown).

Referring to FIGS. 2 and 3, there is in the right-hand compartment of casing 10 a manual toggle switch 118 for the connection and disconnection of the POWER PAC unit with a suitable commercial source of electrical power, an indicator lamp 120 indicating that the POWER PAC unit is so connected, and a normally open safety interconnect switch 122 for connecting and disconnecting the cell 34 and the POWER PAC unit. The normally open switch 122 has a plunger, see FIG. 3, engaged by the grille 94 when the grille is assembled in position in the inlet, to move switch 122 to a closed position to connect the POWER PAC unit to a suitable power source.

When assembling the cell 34 in the casing 10, the ends of rods 74 are entered into the horizontal slots 76 in brackets 78 through the vertical entry slots 80. The cell may then be moved leftwardly sufficiently to permit raising the right-hand end of cell 34 into position to place it on the flange 33 of dividing panel 32. The cell is then moved rightwardly horizontally into position on flange 33 with the nut 82 thereon in registry with screw 84, and the screw 84 is then tightened. When cell 34 is thus moved horizontally rightward into position on flange 33, the spring loaded contact element mounted on the cell 34 engages the stationary contact 88 on the POWER PAC to connect the cell 34 to the POWER PAC.

When removing the cell 34 from casing 10, the screw 84 is disengaged from the nut 82 and is retained in a cup 124 attached to flange 33. The cell 34 is then moved leftward slightly to clear the flange 33 after which the right end may swing outward on the trunnions formed by the projecting ends of rod 74. Thereafter, the trunnions are conveniently removed from the brackets 78 through the vertical slots 80 and the cell 34 removed from casing 10.

The convenient detachable hinged mounting of the cell 34 in casing 10 enables the operator to securely grasp the cell as it swings outward, while still being pivotally retained in the casing, thereby minimizing the possibility of dropping it. The same is true when replacing it. Once the left end of cell 34 is pivotally engaged there is no possibility of its falling out, whether the air cleaner is mounted in a horizontal position in an opening in a ceiling, as in the illustrated embodiment, or in a vertical position in an opening in a sidewall.

I claim:

1. An electrostatic air cleaner adapted to be mounted in an opening in the ceiling or sidewall of a room, comprising; an elongated rectangular casing having side and end walls adapted to extend through the opening, an inlet side having an inlet opening therein adapted to face the room and an opposite outlet side partially closed by an outlet wall, a power pac and an ionizing and collector cell mounted in said casing for convenient removal and replacement through said inlet side, said outlet wall having an intermediate rectangular opening therein, an outlet collar projecting outwardly through said rectangular opening and defining an outlet opening, said outlet collar being adjustable so as to define outlet openings of various sizes and comprising two U-form sections with facing open ends and overlapping parallel leg portions in slidably adjustable relationship, and said collar sections each having skirt means lying contiguous with and in overlapping relationship with portions of said outlet wall surrounding said rectangular opening therein.

2. In an electrostatic air cleaner adapted to be mounted in an opening in the ceiling or sidewall of a room, comprising; a rectangular casing having sidewalls adapted to extend through the ceiling or wall opening, an inlet side having an inlet opening therein adapted to face the room and an opposite outlet side having an outlet opening therein, a power pac and an ionizing and collector cell mounted in said casing for convenient removal and replacement, a rectangular grille supporting frame surrounding the inlet side of said casing, said frame being of general T-form in cross section with the stem portion thereof extending inwardly into said casing parallel with and adjacent the inner surfaces of said casing sidewalls, with the outwardly extending flange portion thereof adapted to lie against the ceiling or wall and with the inwardly extending flange portion thereof supporting the periphery of a grille enclosing the inlet side of the casing, said inwardly extending stem portion of said T-form section having a latching groove near the free end thereof and extending around said frame on the side adjacent said casing sidewalls, and means resiliently holding said frame against the inlet side of said casing comprising a plurality of flat elongated latch members lying flat against the inside of said casing walls and mounted thereon for longitudinal sliding movement perpendicular to said frame, each of said latch members having a perpendicularly formed tongue at one end engaging said latching groove, said latch members being slidably extendable outward from the inlet side of said casing sufficiently to facilitate engagement and disengagement of their said tongues with said grooves, and spring means mounted on said casing sidewalls biasing said latching members longitudinally inwardly to resiliently hold said frame against said inlet side of said casing.

3. An electrostatic air cleaner adapted to be mounted in an opening in the ceiling or sidewall of a room, comprising;

a rectangular casing having sidewalls and end walls adapted to extend through the opening, an inlet side having an inlet opening therein adapted to face the room, and an opposite outlet side having an outlet opening therein;

a power pac mounted in said casing;

an ionizing and collector cell in said casing having a rectangular frame having sidewalls parallel with and adjacent said sidewalls of said casing;

means for detachably hinging one end of said cell frame to said casing sidewalls so that the other end thereof may be swung outward from said inlet side of said casing, so that said cell frame may be moved translationally a short distance parallel to said casing sidewalls while still maintaining a hinged connection with said casing, and so that said cell may be removed entirely from said casing;

stop means on said casing adjacent said other end of said cell frame arranged to be engaged by said other end of said cell frame to prevent the outward swinging movement thereof when said cell frame is moved translationally parallel to said casing sidewalls toward said stop means and said cell frame being free to swing outward when it is moved translationally in an opposite direction away from said stop means;

said detachable hinging means including a pair of trunnions attached to and extending perpendicularly from said cell frame sidewalls at said one end thereof and entered into elongated journalling slots extending longitudinally of said casing sidewalls, said journalling slots being formed in wall portions fixed to and lying parallel with said casing sidewalls and being spaced inwardly from said casing sidewalls; and entry slots formed in said wall portions extending perpendicularly from said journalling slots toward said outlet side of said casing to an open end to permit the entry or removal of said trunnions.

4. The electrostatic air cleaner claimed in claim 3 in which said elongated journalling slots and perpendicular entry slots are formed in wall portions of brackets attached to the sidewalls of said casing member, and in which the open ends of said entry slots face the outlet side of said casing.

5. The electrostatic air cleaner claimed in claim 3 in which said stop means comprises a ledge portion on said casing adjacent said other end of said cell frame and in which said cell frame is moved translationally into overlapping relationship with said ledge portion to prevent the outward swinging thereof, and in which means is included for detachably connecting said other end of said cell frame to said ledge portion when in overlapping relationship therewith.

* * * * *